US011469510B1

(12) United States Patent
Huang

(10) Patent No.: US 11,469,510 B1
(45) Date of Patent: Oct. 11, 2022

(54) SIGNAL SHIELDING AND TRANSMITTING CASE WITH LENGTH-ADJUSTABLE ANTENNA

(71) Applicant: SHENZHEN LEOKE TECHNOLOGY CO., LTD, Shenzhen (CN)

(72) Inventor: Xiping Huang, Shenzhen (CN)

(73) Assignee: SHENZHEN LEOKE TECHNOLOGY CO., LTD, Shenzhen (CN)

( * ) Notice: Subject to any disclaimer, the term of this patent is extended or adjusted under 35 U.S.C. 154(b) by 86 days.

(21) Appl. No.: 17/224,139

(22) Filed: Apr. 7, 2021

(30) Foreign Application Priority Data

Mar. 24, 2021 (CN) ..... 202110316223.9

(51) Int. Cl.

| | |
|---|---|
| ***H01Q 9/30*** | (2006.01) |
| ***H01Q 1/10*** | (2006.01) |
| ***H01Q 1/52*** | (2006.01) |
| *H01Q 1/32* | (2006.01) |

(52) U.S. Cl.
CPC ..... *H01Q 9/30* (2013.01); *H01Q 1/10* (2013.01); *H01Q 1/526* (2013.01); *H01Q 1/3241* (2013.01)

(58) Field of Classification Search
CPC H01Q 1/08; H01Q 1/10; H01Q 1/103; H01Q 1/106; H01Q 1/244; H01Q 1/40; H01Q 1/42; H01Q 1/52; H01Q 1/526; H01Q 1/3241; H01Q 9/28; H01Q 9/30; H01Q 9/40; H01Q 9/46
See application file for complete search history.

(56) References Cited

U.S. PATENT DOCUMENTS

| | | | | |
|---|---|---|---|---|
| 6,046,699 | A * | 4/2000 | Elliott | H01Q 1/244 343/702 |
| 2002/0118135 | A1* | 8/2002 | Johnson | H01Q 1/10 343/900 |
| 2004/0070542 | A1* | 4/2004 | Takebe | H01Q 1/244 343/702 |
| 2006/0290577 | A1* | 12/2006 | Ozkar | H01Q 1/36 343/702 |
| 2008/0074329 | A1* | 3/2008 | Caballero | H01Q 1/088 343/702 |
| 2012/0223871 | A1* | 9/2012 | Chen | H01Q 1/2275 343/883 |
| 2015/0214613 | A1* | 7/2015 | Backman | H01Q 9/26 343/803 |
| 2016/0294049 | A1* | 10/2016 | Hermann | H01H 9/0235 |
| 2018/0151949 | A1* | 5/2018 | Lin | H01Q 1/3233 |
| 2019/0305403 | A1* | 10/2019 | Wang | H01Q 1/243 |

* cited by examiner

*Primary Examiner* — Jason Crawford

(57) ABSTRACT

A signal shielding and transmitting case with a length-adjustable antenna comprises a remote control part, a signal shielding case, and a PCB and an antenna driving part arranged in the signal shielding case, wherein a control line penetrates through the antenna driving part and is fixedly connected to a signal transmitting antenna, and the remote control part can control the length of the signal transmitting antenna stretching out of the signal shielding case based on the gear lever principle to allow users to adjust the intensity of signals transmitted by the signal transmitting antenna freely.

10 Claims, 4 Drawing Sheets

SIGNAL SHIELDING AND TRANSMITTING CASE WITH LENGTH-ADJUSTABLE ANTENNA

BACKGROUND OF THE INVENTION

1. Technical Field

The invention relates to the technical field of signal shielding and transmitting cases, in particular to a signal shielding and transmitting case with a length-adjustable antenna.

2. Description of Related Art

With the continuous improvement of people's living standard and the rapid development of the car market, cars, as a transportation means, have become more and more popular, and car keys are also becoming more and more popular.

Traditional mechanical car keys have gradually been replaced with existing remote car keys, which remotely control the car body by means of electronic signals and have the advantages of convenience, safety, comfort and the like. However, the remote car keys also have defects, for example, when the keys are placed in clothes or trouser pockets, they may be misoperated, and car information may be stolen. In view of this, existing remote car keys are typically provided with a key case for shielding signals. The key case is generally made of a metal material and shields signals by means of the properties of the metal material. However, the key case is too heavy due to the weight of the metal material and has a large size, which makes it difficult to be used with a single hand and makes it inconvenient to carry in a pocket when not used.

Moreover, the key cases in the prior art cannot realize length adjustment of an antenna, and the adjustment manner is monotonic.

Therefore, it is urgently needed to design a novel signal shielding and transmitting case to solve the above-mentioned problems.

BRIEF SUMMARY OF THE INVENTION

The invention provides a signal shielding and transmitting case with a length-adjustable antenna to solve the technical problems mentioned in the description of the related art.

The invention provides a signal shielding and transmitting case with a length-adjustable antenna. The signal shielding and transmitting case with a length-adjustable antenna comprises a signal shielding case, a remote control part, a PCB, a control line, a signal transmitting antenna, an antenna driving part and a power transmission part, wherein the remote control part is fixedly connected to one side of the signal shielding case, the PCB is arranged in the signal shielding case, the antenna driving part is arranged on one side of the PCB, the power transmission part is arranged in the remote control part, the control line penetrates through the antenna driving part and is fixedly connected to the signal transmitting antenna, the remote control part drives the power transmission part to rotate to drive the antenna driving part to rotate, and the antenna driving part drives the control line to move to enable the signal transmitting antenna to stretch out or retreat in the signal shielding case.

Optionally, the power transmission part comprises a first gear, a connector and a second gear, wherein the first gear and the second gear are sequentially disposed around the connector, the first gear abuts against the remote control part, and the second gear abuts against the antenna driving part.

Optionally, a protector is arranged on an outer side of the first gear and is formed with a notch, and one side of the first gear stretches out of the notch to abut against the remote control part.

Optionally, the remote control part comprises a fixing part and a sliding part, wherein the fixing part is fixedly connected to an upper side of the signal shielding case, the sliding part is slidably connected into the fixing part, and a first driving strip is fixedly connected to a side, facing the interior of the fixing part, of the sliding part and abuts against the power transmission part.

Optionally, anti-skid protrusions are arranged on a side, away from the fixing part, of the sliding part.

Optionally, a first fixing cavity and a second fixing cavity are formed in one side of the antenna driving part, and a portion, stretching into the antenna driving part, of the control line sequentially penetrates through the first fixing cavity and the second fixing cavity.

Optionally, a limiting pole for limiting the control line is fixedly connected to the PCB, a limiting sleeve for controlling the moving track of the control line is disposed around the limiting pole, and the control line slides in the limiting sleeve to control the signal transmitting antenna to move.

Optionally, the signal shielding case comprises an upper shielding case and a lower shielding case which are detachably connected, and the upper shielding case and the lower shielding case are both electroplated components.

Optionally, a groove part is fixedly connected to an inner wall of the lower shielding case, and when assembled in the lower shielding case, the upper shielding case abuts against the groove part.

Optionally, a fixing plate is fixedly connected to one side of the signal shielding case, a protective sleeve is detachably connected to an outer side of the fixing plate, multiple limiting grooves are formed in the fixing plate, two symmetrical limiting blocks for locking the protective sleeve are slidably arranged on a side, away from the signal shielding case, of the fixing plate and are connected through a spring, and the limiting blocks slide in the limiting grooves to lock or unlock the protective sleeve.

The invention has the following beneficial effects;

The signal shielding and transmitting case with a length-adjustable antenna comprises the signal shielding case, the remote control part, the PCB, the control line, the signal transmitting antenna, the antenna driving part and the power transmission part, wherein the remote control part is fixedly connected to one side of the signal shielding case, the PCB is arranged in the signal shielding case, the antenna driving part is arranged on one side of the PCB, the power transmission part is arranged in the remote control part, the control line penetrates through the antenna driving part and is fixedly connected to the signal transmitting antenna, the remote control part drives the power transmission part to rotate to drive the antenna driving part to rotate, and then the antenna driving part controls the control line to move to enable the signal transmitting antenna to stretch out or retreat into the signal shielding case, wherein the remote control part can control the control line based on the gear lever principle, such that the length of the signal transmitting antenna stretching out of the signal shielding case can be controlled to allow users to adjust the intensity of signals transmitted by the signal transmitting antenna freely; moreover, different diameter ratios can be set for the power transmission part to make the signal shielding and transmitting case more easy and convenient to adjust, and remote keys can be prevented from being misoperated or getting lost.

BRIEF DESCRIPTION OF THE SEVERAL VIEWS OF THE DRAWINGS

To more clearly explain the technical solutions of the embodiments of the invention, drawings used for describing the embodiments will be briefly introduced below. Obviously, the drawings in the following description merely illustrate some embodiments of the invention, and those ordinarily skilled in the art can obtain other drawings according to the following ones without creative labor.

Figure 1:
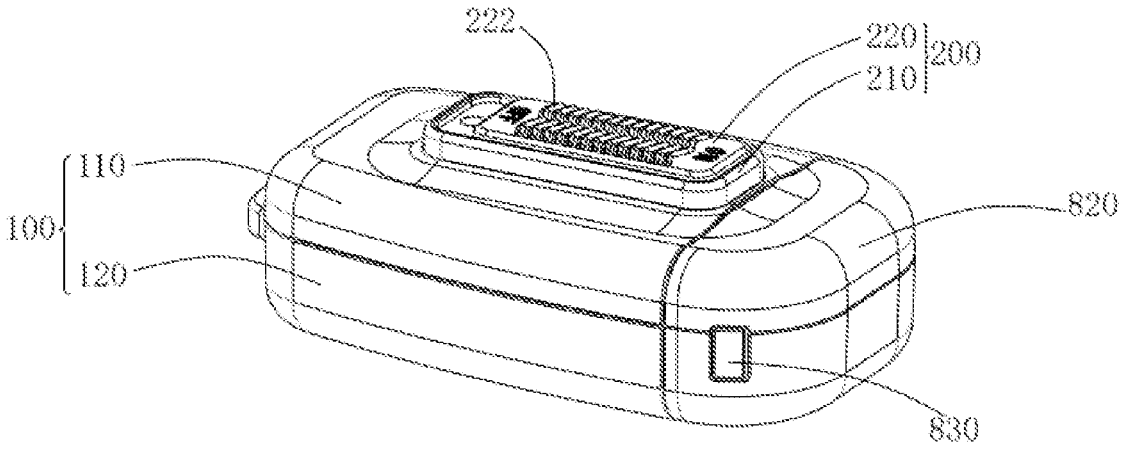
FIG. 1 is a structural view of a signal shielding and transmitting case with a length-adjustable antenna according to the invention.

In the figures: 100, signal shielding case; 110, upper shielding case; 120, lower shielding case; 130, groove part; 200, remote control part; 210, fixing part; 220, sliding part; 221, first driving strip; 222, anti-skid protrusion; 300, PCB; 310, limiting pole; 320, limiting sleeve; 400, control line; 500, signal transmitting antenna; 600, antenna driving part; 610, first fixing cavity; 620, second fixing cavity; 700, power transmission part; 710, first gear; 711, protector; 712, notch; 720, connector; 730, second gear; 800, fixing plate; 810, limiting groove; 820, protective sleeve; 830, limiting block; 840, spring.

DETAILED DESCRIPTION OF THE INVENTION

The technical solutions of the embodiments of the invention will be clearly and completely described below in conjunction with the drawings of the embodiments. It should be understood that the specific embodiments described below are merely used to explain the invention, and are not intended to limit the invention. It should also be noted that for the sake of a brief description, only those parts relating to the invention rather than all structures are illustrated in the drawings. All other embodiments obtained by those ordinarily skilled in the art based on the following ones without creative labor should also fall within the protection scope of the invention.

"Embodiment" mentioned in the specification means that specific features, structures or characteristics described in conjunction with the "embodiment" may be included in at least one embodiment of the invention. Embodiments mentioned in different parts of the specification do not definitely refer to identical embodiments, or independent or alternative embodiments against other embodiments. Those skilled in the art can explicitly or implicitly understand that the embodiments described in the specification can be combined with other embodiments.

Figure 2:
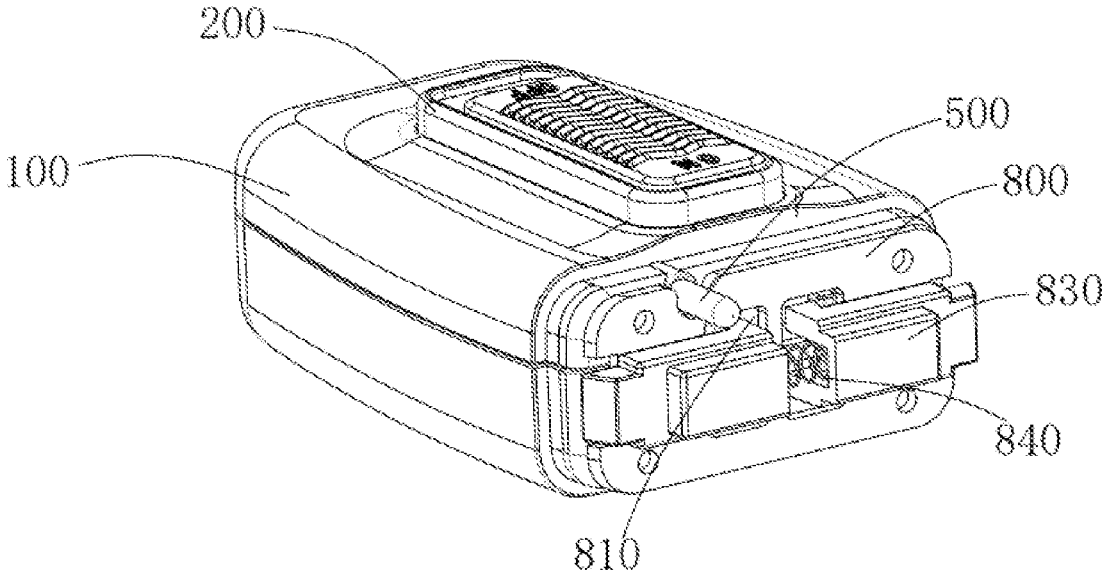
FIG. 2 is a structural view of one embodiment of the signal shielding and transmitting case with a length-adjustable antenna according to the invention.
Figure 3:
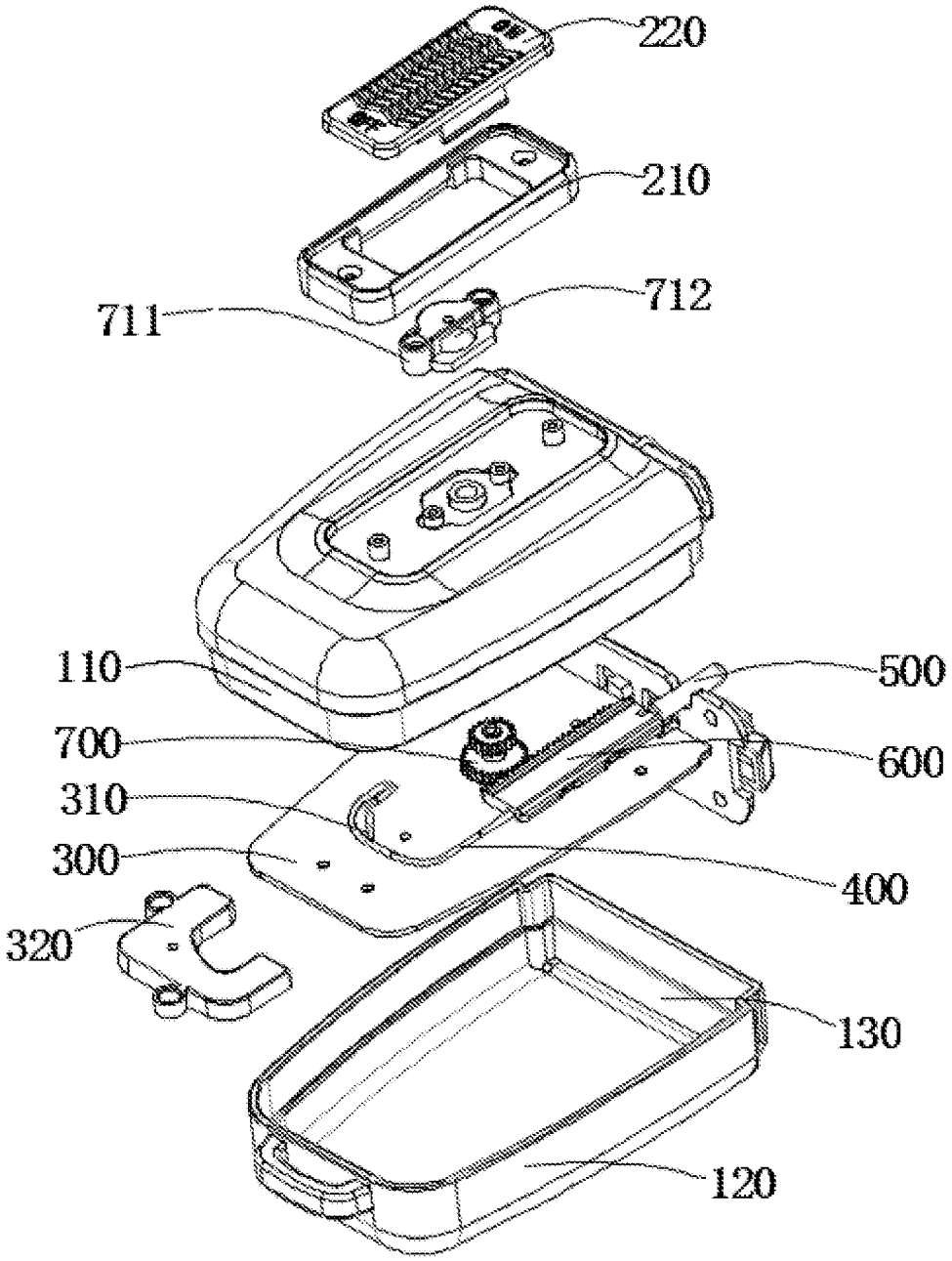
FIG. 3 is an exploded view of the signal shielding and transmitting case with a length-adjustable antenna according to the invention.
Figure 4:
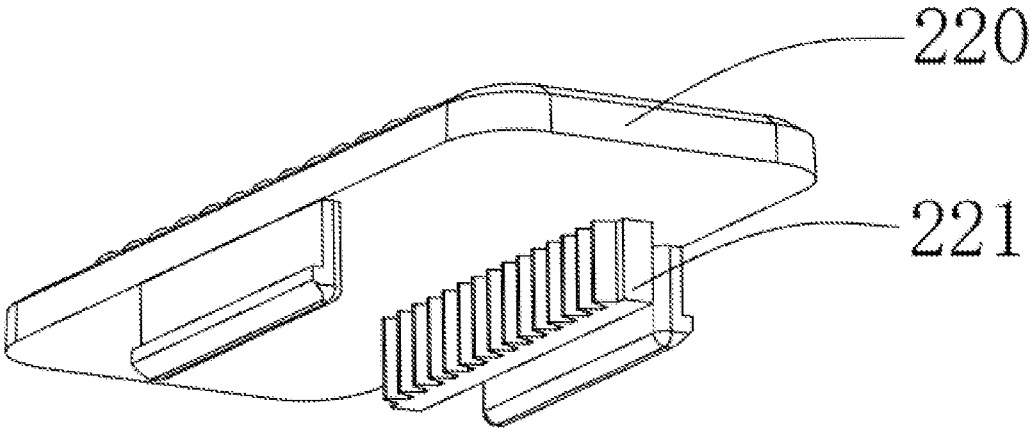
FIG. 4 is a structural view of one embodiment of a sliding part according to the invention.
Figure 5:
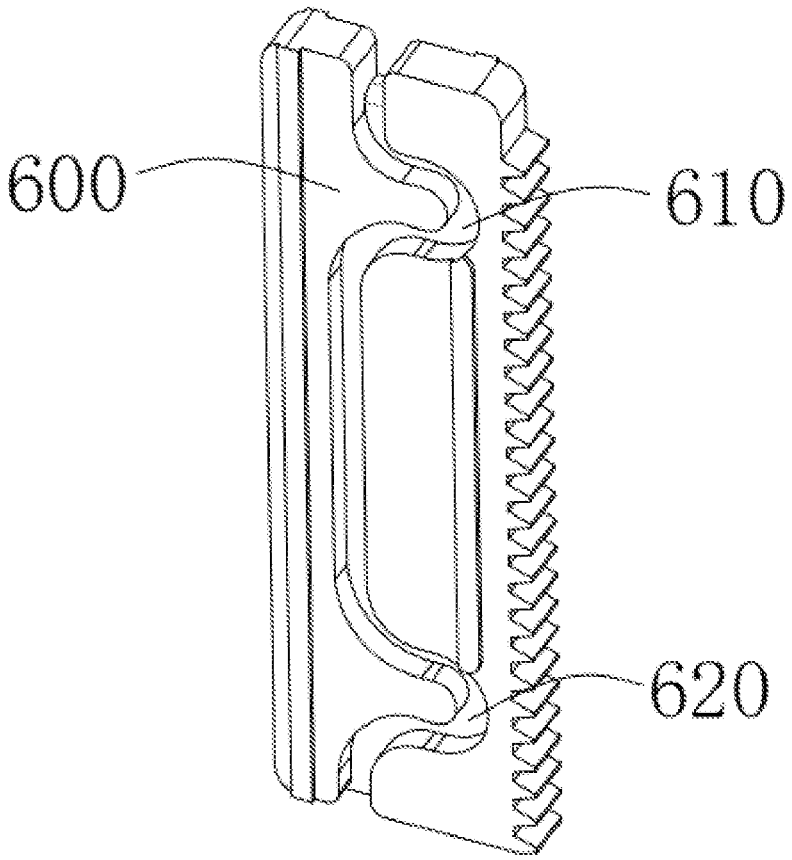
FIG. 5 is a structural view of one embodiment of an antenna driving part according to the invention.
Figure 6:
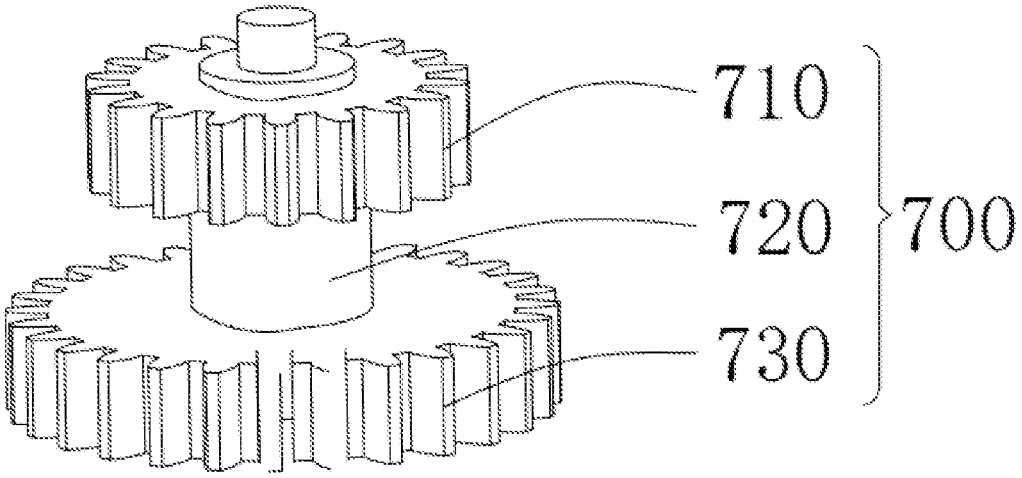
FIG. 6 is a structural view of one embodiment of a power transmission part according to the invention.

Refer to FIG. 1 to FIG. 6, wherein FIG. 1 is a structural view of a signal shielding and transmitting case with a length-adjustable antenna according to the invention; FIG. 2 is a structural view of one embodiment of the signal shielding and transmitting case with a length-adjustable antenna according to the invention; FIG. 3 is an exploded view of the signal shielding and transmitting case with a length-adjustable antenna according to the invention; FIG. 4 is a structural view of one embodiment of a sliding part 220 according to the invention; FIG. 5 is a structural view of one embodiment of an antenna driving part 600 according to the invention; FIG. 6 is a structural view of one embodiment of a power transmission part 700 according to the invention.

A signal shielding and transmitting case with a length-adjustable antenna comprises a signal shielding case 100, a remote control part 200, a PCB 300, a control line 400, a signal transmitting antenna 500, an antenna driving part 600 and a power transmission part 700.

The remote control part 200 is fixedly connected to one side of the signal shielding case 100, the PCB 300 is arranged in the signal shielding case 100, the antenna driving part 600 is arranged on one side of the PCB 300, the power transmission part 700 is arranged in the remote control part 200, the control line 400 penetrates through the antenna driving part 600 and is fixedly connected to the signal transmitting antenna 500, the remote control part 200 drives the power transmission part 700 to rotate, then the power transmission part 700 drives the antenna driving part 600 to rotate, and the antenna driving part 600 controls the control line 400 to move to enable the signal transmitting antenna 500 to stretch out or retreat into the signal shielding case 100.

Wherein, the signal shielding case 100 can be applied to remote control keys, navigator, positioners or other products to shield electromagnetic signals; the PCB 300 is installed in the signal shielding case 100, and the signal shielding case 100 has a shielding effect on the signal transmitting antenna 500, such that the signal transmitting antenna 500 will not send a control signal to external equipment that is to be remotely controlled unless it is stretched out of the signal shielding case 100 by users, and misoperation can be effectively avoided.

Moreover, when the signal transmitting antenna 500 stretches out of the signal shielding case 100 by different lengths, the intensities of signals transmitted by the signal transmitting antenna 500 will be different, such that the length of the signal transmitting antenna 500 stretching out of the signal shielding case 100 can be controlled by users according to the distance to the external equipment to be controlled to make operations more intelligent.

The signal transmitting antenna 500 is electrically connected to the PCB 300, so that the signal transmitting antenna 500 can generate signals for controlling the external equipment.

Furthermore, when using the signal shielding and transmitting case with a length-adjustable antenna, users control the remote control part 200 to slide at first to drive the power transmission part 700 to rotate, then the power transmission part 700 drives the antenna driving part 600 to move, then the control line 400 is driven by the antenna driving part 600 to move, and the signal transmitting antenna 500 is driven by the control line 400 to stretch out or retreat into the signal shielding case 100. In this way, the signal transmitting antenna 500 can be freely controlled to stretch out of the signal shielding case 100.

Referring to FIG. 6 again, in this embodiment, the power transmission part 700 comprises a first gear 710, a connector 720 and a second gear 730, wherein the first gear 710 and the second gear 730 are sequentially disposed around the connector 720, the first gear 710 abuts against the remote control part 200, and the second gear 730 abuts against the antenna driving part 600.

Wherein, when users slide the remote control part 200, the first gear 710 is driven to rotate at first to drive the connector 720 to rotate synchronously; when the connector 720 rotates, the second gear 730 rotates along with the connector 720 to drive the antenna driving part 600 to rotate, then the antenna driving part 600 drives the control line 400 to rotate, and finally, the control line 400 drives the signal transmitting antenna 500 to move.

In this embodiment, diameter ratio of the first gear 710 and the second gear 730 is 1:1, 1:1.1, 1:1.2, 1:1.3, 1:1.4 or 1:1.5.

Wherein, users can set the diameter ratio of the first gear 710 and the second gear 730 according to specific service environments. By changing the diameter ratio of the first gear 710 and the second gear 730, when the users control the remote control part 200 to drive the first gear 710 to rotate, the signal transmitting antenna 500 will move by different distances due to different diameter ratios of the first gear 710 and the second gear 730 even if the users control the remote control part 200 to slide by the same distance. It should be noted that the invention has no limitation on the specific diameter ratio of the first gear 710 and the second gear 730, that is, the diameter ratio of the first gear 710 and the second gear 720 can be set freely.

Referring to FIG. 3 again, in this embodiment, a protector 711 is arranged on the outer side of the first gear 710 and is formed with a notch 712, and one side of the first gear 710 stretches out of the notch 712 to abut against the remote control part 200.

Wherein, the protector 711 can reduce the contact area between the first gear 710 and the remote control part 200 and can protect the first gear 710, so that the service life of the first gear 710 is prolonged.

That is, in this embodiment, the remote control part 200 only contacts with the portion, stretching out of the notch 712, of the first gear 710.

In this embodiment, the remote control part 200 comprises a fixing part 210 and a sliding part 220, wherein the fixing part 210 is fixedly connected to the upper side of the signal shielding case 100, the sliding part 220 is slidably connected into the fixing part 210, and a first driving strip 221 is fixedly connected to a side, facing the interior of the fixing part 210, of the sliding part 220 and abuts against the power transmission part 700.

Wherein, when users need to control the length of the signal transmission antenna 500 stretching out of the signal shielding case 100, the position of the fixing part 210 is fixed, the sliding part 220 slides in the fixing part 210 to drive the first driving strip 221 to slide, and then the first driving strip 221 drives the first gear 710 in the power transmission part 700 to rotate. In this way, the first gear 710 is driven, and the first driving strip 221 and the first gear 710 may be engaged.

In this embodiment, anti-skid protrusions 222 are arranged on a side, away from the fixing part 210, of the sliding part 220.

Wherein, the anti-skid 222 protrusions are arranged regularly or irregularly and can enlarge the contact area between users and the sliding part 220, so that the users can adjust the sliding part 220 easily.

In this embodiment, a first fixing cavity 610 and a second fixing cavity 620 are formed in one side of the antenna driving part 600, and a portion, stretching into the antenna driving part 600, of the control line 400 sequentially penetrates through the first fixing cavity 610 and the second fixing cavity 620.

Wherein, the portion, stretching into the antenna driving part 600, of the control line 400 can be clamped and fixed by the first fixing cavity 610 and the second fixing cavity 620, so that when the position of the antenna driving part 600 changes, the control line 400 can better move along with the antenna driving part 600. Of course, the purpose of clamping the control line 400 can also be realized if only one of the first fixing cavity 610 and the second fixing cavity 620 is configured.

In this embodiment, a limiting pole 310 for limiting the control line 400 is fixedly connected to the PCB 300, a limiting sleeve 320 for limiting the moving track of the control line 400 is disposed around the limiting pole 310, and the control line 400 slides in the limiting sleeve 320 to control the movement of the signal transmitting line 500.

Wherein, the limiting sleeve 320 can limit the control line 400 to prevent it from being out of order in the signal shielding case 100, and the limiting pole 310 is fixedly connected to the PCB 300 and is electrically connected to the PCB 300. When users controls the signal transmitting antenna 500 to stretch out or retreat into the signal shielding case 100, the control line moves in order under the effect of the limiting sleeve 320.

In this embodiment, the signal shielding case 100 comprises an upper shielding case 110 and a lower shielding case 120 which are detachably connected, and the upper shielding case 110 and the lower shielding case 120 are both electroplated components.

Wherein, the upper shielding case 110 and the lower shielding case 120 are detachably connected, so that the internal structures of the upper shielding case 110 and the lower shielding case 120 can be changed and maintained in time.

Moreover, the upper shielding case 110 and the lower shielding case 120 are both electroplated, so that an electromagnetic shielding effect is realized through the cooperation of the upper shielding case 110 and the lower shielding case 120.

In this embodiment, a groove part 130 is fixedly connected to the inner wall of the lower shielding case 120; when the upper shielding case 110 is assembled in the lower shielding case 120, the periphery of the upper shielding case 110 exactly abuts against the groove part 130, that is, a boss matched with the groove part 130 is formed on the periphery of the upper shielding case 110, so that the upper shielding case 110 can be exactly connected into the groove part 130, and the electromagnetic shielding effect of the upper shielding case 110 and the lower shielding case 120 is improved.

Wherein, when the periphery of the upper shielding case 110 abuts against the groove part 130, the overall electromagnetic shielding effect on signals of the signal shielding case 100 is improved. In another embodiment, no groove part 130 is arranged in the lower shielding case 120, and when the upper shielding case 110 stretches into the lower shielding case 120 deeply enough, the electromagnetic shielding effect can still be realized.

In this embodiment, a fixing plate 800 is fixedly connected to one side of the signal shielding case 100, a protective sleeve 820 is detachably connected to the outer side of the fixing plate 800, multiple limiting grooves 810 are formed in the fixing plate 800, two symmetrical limiting blocks 830 for locking the protective sleeve 820 are slidably arranged on a side, away from the signal shielding case 100, of the fixing plate 800 and are connected through a spring 840, and the limiting blocks 830 slide in limiting grooves 810 to lock or unlock the protective sleeve 820.

Wherein, the fixing plate 800 can improve the stability of the signal shielding and transmitting case, and the protective sleeve 820 can be disposed around one side of the signal shielding case 100 to protect the signal transmitting antenna 500 and can prevent dust to some certain extent to prolong the service life of the signal shielding and transmitting case.

Moreover, the limiting blocks 830 can lock the protective sleeve 820; when the two limiting blocks 830 squeeze each other, the protective sleeve 820 will no longer be locked by the limiting blocks 830 and can be detached freely; when a force applied to the limiting blocks 830 disappears, the limiting blocks 830 return to initial positions under the elastic effect of the spring 840.

The signal shielding and transmitting case with a length-adjustable antenna comprises the signal shielding case 100, the remote control part 200, the PCB 300, the control line 400, the signal transmitting antenna 500, the antenna driving part 600 and the power transmission part 700, wherein the remote control part 200 is fixedly connected to one side of the signal shielding case 100, the PCB 300 is arranged in the signal shielding case 100, the antenna driving part 600 is arranged on one side of the PCB 300, the power transmission part 700 is arranged in the remote control part 200, the control line 400 penetrates through the antenna driving part 600 and is fixedly connected to the signal transmitting antenna 500, the remote control part 200 drives the power transmission part 700 to rotate to drive the antenna driving part 600 to rotate, and then the antenna driving part 600 controls the control line 400 to move to enable the signal transmitting antenna 500 to stretch out or retreat into the signal shielding case 100, wherein the remote control part 200 can control the control line 400 based on the gear lever principle, such that the length of the signal transmitting antenna 500 stretching out of the signal shielding case 100 can be controlled to allow users to adjust the intensity of signals transmitted by the signal transmitting antenna 500 freely; moreover, different diameter ratios can be set for the power transmission part 700 to make the signal shielding and transmitting case more easy and convenient to adjust, and remote keys can be prevented from being misoperated or getting lost.

The above description is merely used to explain the embodiments of the invention, and is not intended to limit the scope of the patent of invention. All equivalent structure or process transformations made according to the contents of the specification and the drawings of the invention, or direct or indirect applications to other relating technical fields should also fall within the protection scope of the patent of invention.

What is claimed is:

1. A signal shielding and transmitting case with a length-adjustable antenna, comprising a signal shielding case, a remote control part, a PCB, a control line, a signal transmitting antenna, an antenna driving part and a power transmission part, wherein the remote control part is fixedly connected to one side of the signal shielding case, the PCB is arranged in the signal shielding case, the antenna driving part is arranged on one side of the PCB, the power transmission part is arranged in the remote control part, the control line penetrates through the antenna driving part and is fixedly connected to the signal transmitting antenna, the remote control part drives the power transmission part to rotate to drive the antenna driving part to rotate, and the antenna driving part drives the control line to move to enable the signal transmitting antenna to stretch out or retreat in the signal shielding case.

2. The signal shielding and transmitting case with a length-adjustable antenna according to claim 1, wherein the power transmission part comprises a first gear, a connector and a second gear, the first gear and the second gear are sequentially disposed around the connector, the first gear abuts against the remote control part, and the second gear abuts against the antenna driving part.

3. The signal shielding and transmitting case with a length-adjustable antenna according to claim 2, wherein a protector is arranged on an outer side of the first gear and is formed with a notch, and one side of the first gear stretches out of the notch to abut against the remote control part.

4. The signal shielding and transmitting case with a length-adjustable antenna according to claim 1, wherein the remote control part comprises a fixing part and a sliding part, the fixing part is fixedly connected to an upper side of the signal shielding case, the sliding part is slidably connected into the fixing part, and a first driving strip is fixedly connected to a side, facing an interior of the fixing part, of the sliding part and abuts against the power transmission part.

5. The signal shielding and transmitting case with a length-adjustable antenna according to claim 4, wherein anti-skid protrusions are arranged on a side, away from the fixing part, of the sliding part.

6. The signal shielding and transmitting case with a length-adjustable antenna according to claim 1, wherein a first fixing cavity and a second fixing cavity are formed in one side of the antenna driving part, and a portion, stretching into the antenna driving part, of the control line sequentially penetrates through the first fixing cavity and the second fixing cavity.

7. The signal shielding and transmitting case with a length-adjustable antenna according to claim 1, wherein a limiting pole for limiting the control line is fixedly connected to the PCB a limiting sleeve for controlling a moving track of the control line is disposed around the limiting pole, and the control line slides in the limiting sleeve to control the signal transmitting antenna to move.

8. The signal shielding and transmitting case with a length-adjustable antenna according to claim 1, wherein the signal shielding case comprises an upper shielding case and a lower shielding case which are detachably connected, and the upper shielding case and the lower shielding case are both electroplated components.

9. The signal shielding and transmitting case with a length-adjustable antenna according to claim 1, wherein a groove part is fixedly connected to an inner wall of the lower shielding case, and when assembled in the lower shielding case, the upper shielding case abuts against the groove part.

10. The signal shielding and transmitting case with a length-adjustable antenna according to claim 1, wherein a fixing plate is fixedly connected to one side of the signal shielding case, a protective sleeve is detachably connected to an outer side of the fixing plate, multiple limiting grooves are formed in the fixing plate, two symmetrical limiting blocks for locking the protective sleeve are slidably arranged on a side, away from the signal shielding case, of the fixing plate and are connected through a spring, and the limiting blocks slide in the limiting grooves to lock or unlock the protective sleeve.

* * * * *